United States Patent [19]

Hirayama et al.

[11] 4,433,322

[45] Feb. 21, 1984

[54] VARIABLE RESISTOR

[75] Inventors: Masaru Hirayama; Nobuaki Anzai; Ryusuke Shirouzu, all of Miyagi, Japan

[73] Assignee: Alps Electric Co., Ltd., Tokyo, Japan

[21] Appl. No.: 349,974

[22] Filed: Feb. 18, 1982

[30] Foreign Application Priority Data

Feb. 18, 1981 [JP] Japan ..... 56-20728[U]
Mar. 23, 1981 [JP] Japan ..... 56-39046[U]

[51] Int. Cl.[3] ..... H01C 10/32
[52] U.S. Cl. ..... 338/162; 338/202
[58] Field of Search ..... 338/162, 163, 160, 174, 338/188, 197, 202, 322, 325; 29/610 R

[56] References Cited

U.S. PATENT DOCUMENTS 3,377,605 4/1968 Baskett ..... 338/162
3,772,630 11/1973 Falco ..... 338/174
3,947,800 3/1976 Benthuysen et al. ..... 338/163
3,997,865 12/1976 George ..... 338/162 X

*Primary Examiner*—C. L. Albritton
*Attorney, Agent, or Firm*—Guy W. Shoup; Gerard F. Dunne

[57] ABSTRACT

A variable resistor including an insulating substrate carrying a resistor layer and a rotatable slider has an insulating spacer separating the slider from the insulating substrate by an appropriate distance. The insulating spacer is formed of a synthetic resin molded directly on one surface of the slider and is integrally secured to the slider by having portions of the resin extending through holes formed in the slider. Thus, the number of overall components of the resistor is reduced to facilitate assembly and make management of the components easier.

6 Claims, 8 Drawing Figures

VARIABLE RESISTOR

BACKGROUND OF THE INVENTION

The present invention relates to variable resistors of the semifixed type and the like for use in such items as small-sized consumer goods.

There has heretofore been known a variable resistor having an insulating substrate carrying a resistor layer, and a slider mounted rotatably on the insulating substrate and having a contact piece adapted to turn in sliding contact with the resistor layer. An insulating spacer is often pivoted to separate the slider from the insulating substrate by an appropriate distance. In such variable resistors, the insulating spacer is typically formed of a separate member. The prior art, therefore, involves considerably troublsome operations of assemblage and a troublesome component management due to an increased number of components.

SUMMARY OF THE INVENTION

The present invention has been made in view of such problems of the prior art, and has for its object to solve the problems.

According to one aspect of performance of the present invention, an insulating spacer is formed integrally on on surface of a slider by outsert molding a synthetic resin, with some of the resin extending through holes penetrating through the slider to hold the slider and the spacer integrally together.

BRIEF DESCRIPTION OF THE DRAWINGS

FIG. 3 is a plan view of the variable resistor in FIG. 2, FIGS. 4 to 6 are explanatory views illustrative of an example of a method of forming an insulating spacer by the outsert molding process, in which

DETAILED DESCRIPTION OF THE INVENTION

Figure 1:
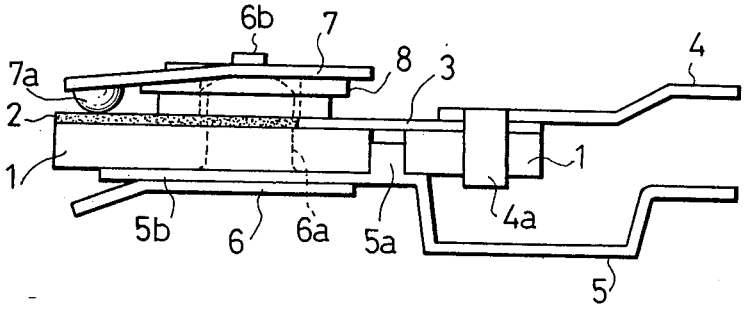
Fig.1 (PRIOR ART)
FIG. 1 is a side view showing a prior-art variable resistor.

Before describing the preferred embodiments of the present invention, there will be explained a prior-art variable resistor as shown by way of example in FIG. 1.

Referring to the figure, numeral 1 designates an insulating substrate, on which a resistor layer 2 made of a carbon film or the like is formed.

The resistor layer 2 is formed to be semicircular when viewed in plan, and its end parts are connected to respective terminals 4 through conductor layers 3 which principally contains silver. Each terminal 4 is fixed to the insulating substrate 1 by a mounting portion 4*a*. On the lower surface of the insulating substrate 1 as viewed in FIG. 1, an intermediate terminal 5 is fixed to the insulating substrate 1 by a mounting portion 5*a*. Further, a metallic adapter plate 6 is held in opposed contact with an extension portion 5*b* of the intermediate terminal. The metallic adapter plate 6 has a cylindrical portion 6*a*, which is protruded onto the side of the resistor layer 2 while loosely penetrating the extension portion 5*b* and the insulating substrate 1.

The protruded end part of the cylindrical portion 6*a* is provided with engaging tongues 6*b*. Numeral 7 designates a slider, and symbol 7*a* represents a contact piece which is disposed at the fore end part of the slider 7. In the central part of the slider 7, an engaging hole is formed to receive the engaging tongues 6*b* which can be bent over and caulked. Owing to the caulking, the slider 7 and the metallic adapter plate 6 are unitarily attached to each other, and the slider 7 can be turned relative the insulating substrate 1, and is joined to the intermediate terminal 5 through the metallic adapter plate 6.

An annular insulating spacer 8 is interposed between the insulating substrate 1 and the slider 7. Owing to the insulating spacer 8, the slider 7 is prevented from contacting the resistor layer 2 at any point other than its contact piece 7*a*, and the pressing contact force of the contact piece 7*a* on the resistor layer 2 is properly adjusted to permit smooth turning of the slider 7.

At an appropriate location on the upper surface part of the contact piece 7*a* as viewed in FIG. 1, a symbol for the resistance value, the type etc. of the variable resistor is properly indicated.

By the operation of turning the slider 7, the path between the intermediate terminal 5 and either terminal 4 is adjusted to a desired resistance value.

In such prior-art variable resistors, however, an insulating spacer formed of a member separate from the substrate and the slider is interposed therebetween resulting in the problems that the operations of assemblage are considerably troublesome and that the component management is troublesome on account of an increased number of components.

The present invention has been made in order to eliminate the problems of the prior art as described above.

Hereunder, the present invention will be described with reference to the drawings.

Figure 2:
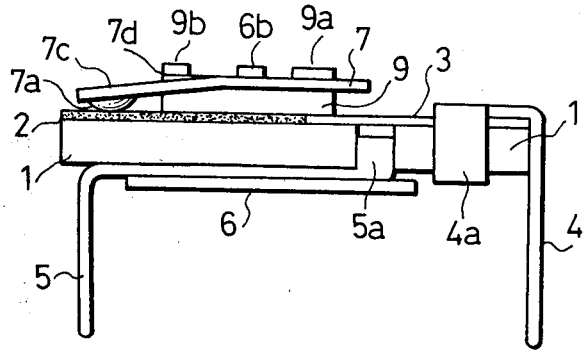
FIG. 2 is a side view showing an embodiment of a variable resistor according to the present invention.

In FIG. 2 and further figures, members or parts identical or equivalent to those in FIG. 1 are assigned the same symbols as mentioned before, and their explanation will not be repeated.

Figure 3:
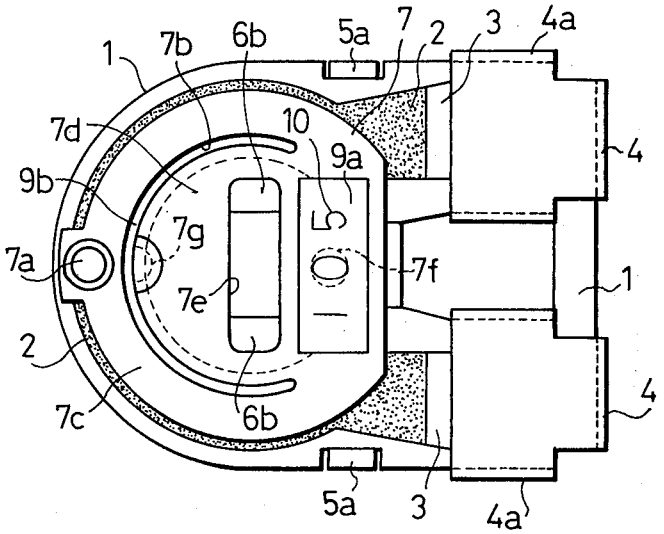

FIGS. 2 and 3 are views showing an embodiment of the present invention. In construction, the external shape of the slider 7 is substantially circular with a groove 7*b* in the shape of a circular arc provided in the circular slider 7, and a semi-annular arm 7*c* and a slider base portion 7*d* formed in a manner to be divided by the groove 7*b*. The arm 7*c* is slightly bent toward the insulating substrate 1 at its part close to an end part of the groove 7*b*, and the contact piece 7*a* is disposed substantially centrally of the semi-annular arm 7*c*. Symbol 7*e* indicates an engaging hole.

According to the present invention, an insulating spacer 9 is formed integrally with the slider 7 in advance by the outsert molding process to be described below, unlike the construction wherein the insulating spacer 8 is separate from the slider 7 etc. as in the prior art illustrated in FIG. 1.

During the outsert molding, the insulating spacer 9 has its parts protruded onto the upper surface side of the slider 7 as viewed in FIG. 2 through penetrating holes 7*f* and 7*g* properly provided in the slider 7. The protrusions 9*a* and 9*b* of the slider sandwich the slider 7 partly therebetween, and serve as a holding portion for the insulating spacer 9. One protrusion 9*a* has its plan shape made into the form of a rectangle, by way of example, and a symbol 10 representative of the resistance value, the type etc. of the variable resistor is carved in the upper surface of the rectangular protrusion 9*a*.

Figure 5:
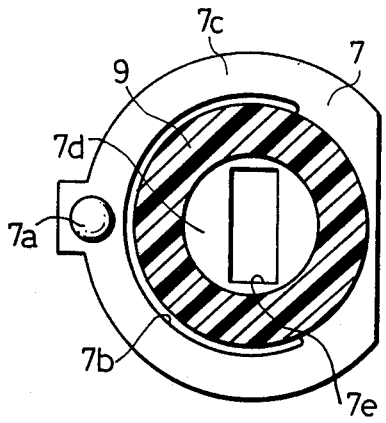
FIG. 5 is a bottom view of the slider with the insulating spacer integrally mounted thereon and FIG. 6 is a plan view of the integral structure.
Figure 6:
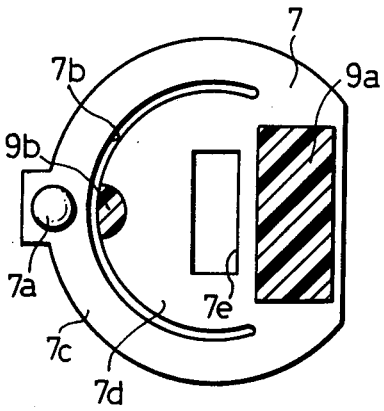

Now, an example of a method of forming the insulating spacer 9 with the outsert molding process will be described with reference to FIGS. 4 to 6.

Figure 4:
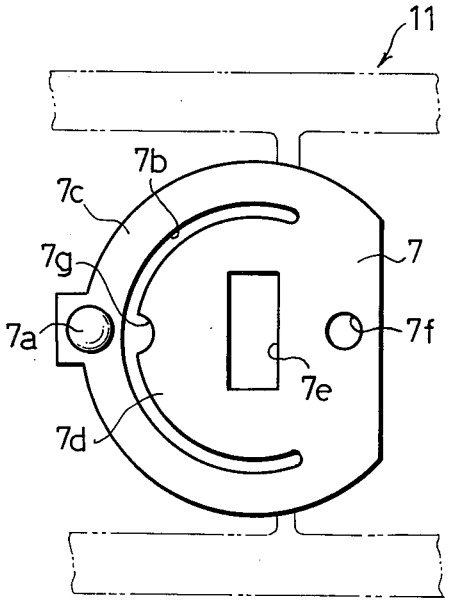
FIG. 4 is a plan view of a slider portion.

First, as shown in FIG. 4, the slider 7 is formed from band steel 11 by punching. Although only one slider 7 is depicted in FIG. 4, a plurality of such sliders 7 are punched and formed in a manner to follow one another in the lengthwise direction of the band steel (in the lateral direction as viewed in the figure). In the punching operation, the groove 7*b*, engaging hole 7*e*, penetrating holes 7*f* and 7*g*, etc. are simultaneously provided.

In the present invention, the expression "penetrating hole" shall also signify a notch-like hole such as the penetrating hole 7*g* facing the groove 7*b*.

Subsequently, with the plurality of sliders 7 left connected together metal molds or masks in predetermined shapes on which a mold releasing agent is applied are held in opposed contact with the surfaces of the sliders 7, and a thermoplastic resin solution of polyacetal or the like is injected through each inlet which corresponds to, for example, one penetrating hole 7*g*. The thermoplastic resin solution fills up the molds and forms the insulating spacer 9, and further flows through the other penetrating hole 7*f* into mold cavities for forming the rectangular protrusion 9*a*.

By the way, the desired symbol may well be carved and formed on the rectangular protrusion 9*a* at the same time as the outsert molding.

After cooling and solidification, the metal molds or masks are released from the state in which the insulating spacers 9 are formed, and the solidified resin forms spacers integrally secured to the sliders 7.

Following this formation, the respective sliders 7 are severed from one another. Then, the structure if finished up to form insulating spacers 9 on one surface of each respective slider with the penetrating holes 7*f* and 7*g* serving to integrally secure the slider to the respective spacer. FIG. 5 is a bottom view of the structure, while FIG. 6 is a plan view thereof.

In operation, when the slider 7 is operated to turn, the insulating spacer 9 turns integrally therewith. A resistance of a value corresponding to the position of the turning operation appears between the intermediate terminal 5 and the terminal 4.

Figure 7:
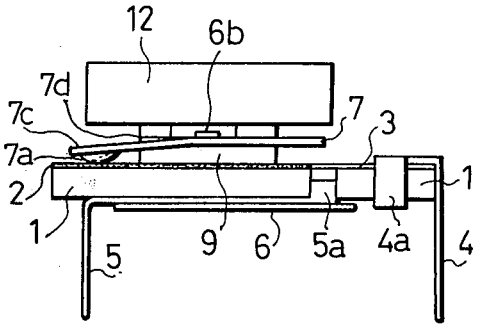
FIG. 7 is a side view showing another embodiment of the present invention.
Figure 8:
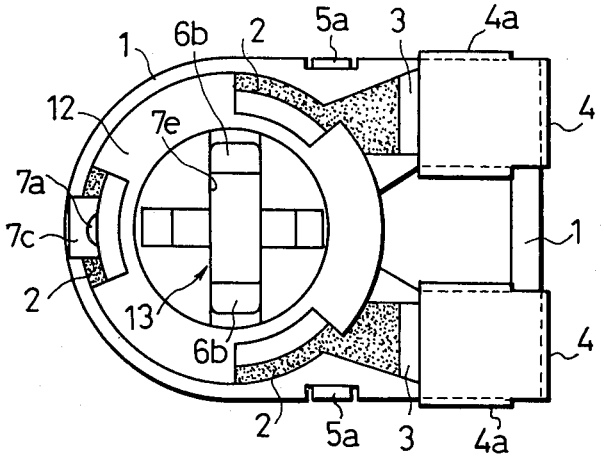
FIG. 8 is a plan view of the embodiment in FIG. 7.

FIGS. 7 and 8 show another embodiment of the present invention. The insulating spacer 9 is integrally formed with a driving portion 12, in which a cruciform groove 13 is formed.

As described above in detail, according to the present invention, an insulating spacer is formed on one surface of a slider provided with proper penetrating holes, by outsert molding with a synthetic resin, and it is integrally secured to the slider through the penetrating holes. Therefore, the number of components of the device decreases by one in comparison with the prior art since a separate insulating spacer which is often of a small size is not needed, so that the job efficiency is sharply simplified. In addition, since the insulating spacer and the slider can be unitarily managed, the component management becomes very easy, and reduction in cost can be achieved. When a driving portion is formed integrally with the insulating spacer and a cruciform groove is provided in the driving portion, adjustments can be made with a plus screwdriver, so that accurate fine adjustments can be readily made by a stable operation.

We claim:

1. In a variable resistor including an insulating substrate carring a resistance layer, a slider mounted for rotation relative said insulating substrate and having a contact portion adapted to be turned in sliding contact with said resistance layer, and an insulating spacer separating said slider from said insulating substrate; the improvement wherein said slider is provided with a plurality of holes extending therethrough, and said insulating spacer is formed from a synthetic resin molded into its shape directly onto a surface of said slider with portions of said synthetic resin extending through said holes to secure said spacer and said slider integrally together to form a unitary component.

2. A variable resistor according to claim 1, a portion of the synthetic resin on the other surface of said slider being molded into a flat protrusion having formed therein a symbol representative of a characteristic of the resistor.

3. A variable resistor according to claim 1, a portion of the synthetic resin on the other surface of said slider being molded into a portion adapted to receive an implement for rotating said unitary spacer and slider.

4. A method of making a variable resistor including an insulating substrate carrying a resistance layer, a slider mounted for rotation relative said insulating substrate and having a contact portion adapted to be turned in sliding contact with said resistance layer, and an insulating spacer separating said slider from said insulating substrate; the steps of providing a plurality of holes extending through said slider, and forming said insulating spacer from a synthetic resin molded into its shape directly onto a surface of said slider with portions of said synthetic resin extending through said holes to secure said spacer and said slider integrally together to form a unitary component.

5. A method according to claim 4, including the step of molding a portion of the synthetic resin on the other surface of said slider into a flat protrusion and forming therein a symboly representative of a characteristic of the resistor.

6. A method according to claim 4, including the step of molding a portion of the synthetic resin on the other surface of said slider into a portion adapted to receive an implement for rotating said unitary spacer and slider.

* * * * *